US006601366B1

(12) United States Patent
Grutter

(10) Patent No.: US 6,601,366 B1
(45) Date of Patent: Aug. 5, 2003

(54) TAG INSERTION DEVICE FOR A BAG TYER

(75) Inventor: William G. Grutter, Belmont, MI (US)

(73) Assignee: Burford Corporation, Maysville, OK (US)

( * ) Notice: Subject to any disclaimer, the term of this patent is extended or adjusted under 35 U.S.C. 154(b) by 0 days.

(21) Appl. No.: 09/522,207

(22) Filed: Mar. 9, 2000

(51) Int. Cl.[7] ..... B65B 61/14
(52) U.S. Cl. ..... 53/133.7; 53/498; 53/500
(58) Field of Search ..... 53/133.7, 483, 53/498, 500, 583

(56) References Cited

U.S. PATENT DOCUMENTS 3,375,634 A 4/1968 Jarund
3,589,092 A 6/1971 Jarund
3,919,829 A * 11/1975 Burford et al. ..... 53/135
4,062,383 A * 12/1977 Saito ..... 140/93
4,215,606 A 8/1980 Britt ..... 83/23
4,398,379 A * 8/1983 Burford ..... 53/77
4,711,064 A 12/1987 Tsuda
4,856,258 A * 8/1989 Burford et al. ..... 53/138
5,483,134 A 1/1996 Frazier et al.
5,708,339 A * 1/1998 Frazier et al. ..... 318/468
5,771,664 A 6/1998 Recchia, Jr.

* cited by examiner

*Primary Examiner*—Scott A. Smith
*Assistant Examiner*—Nathaniel Chukwurah
(74) *Attorney, Agent, or Firm*—Crutsinger & Booth

(57) ABSTRACT

An attachment for supplying printed tabs or tags to a bag neck tying device for tying a ribbon dispensed from a spool about a gathered neck and the printed tag.

12 Claims, 11 Drawing Sheets

TAG INSERTION DEVICE FOR A BAG TYER

TECHNICAL FIELD

The invention relates to a tag attachment accessory to a machine for wrapping a ribbon around the gathered neck of a bag and twisting the ribbon for closing and sealing the neck of the flexible bag.

BACKGROUND OF INVENTION

U.S. Pat. No. 3,138,904 entitled "METHOD AND APPARATUS FOR TYING PACKAGES AND WRAPPING MATERIALS;" U.S. Pat. No. 3,059,670 entitled "WIRE TWISTING TOOL;" U.S. Pat. No. 3,919,829 entitled "APPARATUS FOR TYING PACKAGES AND WRAPPING MATERIALS;" U.S. Pat. No. 4,856,258 entitled "WIRE TYING DEVICE;" and U.S. Pat. No. 5,483,134 entitled "RIBBON SENSING DEVICE FOR BAG TYER" disclose apparatus used for closing a plastic bag by attaching and twisting a wire-like ribbon about the neck of the bag.

Bag tying devices of the type disclosed in the aforementioned patents are commercially available from Burford Corporation of Maysville, Okla. The tying devices are generally constructed to receive packages such as loaves of bread at speeds of for example one hundred (100) packages per minute.

SUMMARY OF INVENTION

The bag neck tying device disclosed herein incorporates a bag neck gathering mechanism comprising motor driven gathering belts for moving a bag neck along a path in a plane into engagement with a bag stop controlled by an electric brake positioned adjacent a ribbon holder-shear assembly which holds the free end of a ribbon of tie material. A motor driven needle wraps the strand of the tie material around the gathered neck of the bag, and a motor driven twister hook assembly engages the free end and the running end of the ribbon adjacent the gathered neck for twisting the ribbon.

Independently controlled bi-directional, brush type servomotors are mounted in the separate subassemblies of the tying device. Each of the servomotors is controlled by a solid state DC motor controller in a closed loop feedback system under the control of a multichannel microcontroller which precisely starts, controls and stops each of the servomotors in a pre-assigned sequence for each cycle of the tying apparatus.

The tag attachment device is a retrofit option to the standard servo-tyer. The tag attachment device can be mounted on the tyer by removing the cover with the two screws, using a drill template to add some additional holes for the air cylinder, removing the gathering belt and adding a pivot point. The gathering belt is replaced and an air cylinder is installed. The tag attachment device assembly itself bolts onto the existing servo-tyer bracket. The only electrical interface between the tag attachment device system and the servo-tyer is one unused contact in the switch that triggers the servo-tyer. A spool holder for a supply of tags and the tag attachment device are then mounted on the frame.

DESCRIPTION OF THE DRAWINGS

Drawings of a preferred embodiment of the invention are annexed hereto so that the invention may be better and more fully understood, in which.

Numeral references are employed to designate like parts throughout the various Figures of the drawing.

DESCRIPTION OF A PREFERRED EMBODIMENT

Figure 1:
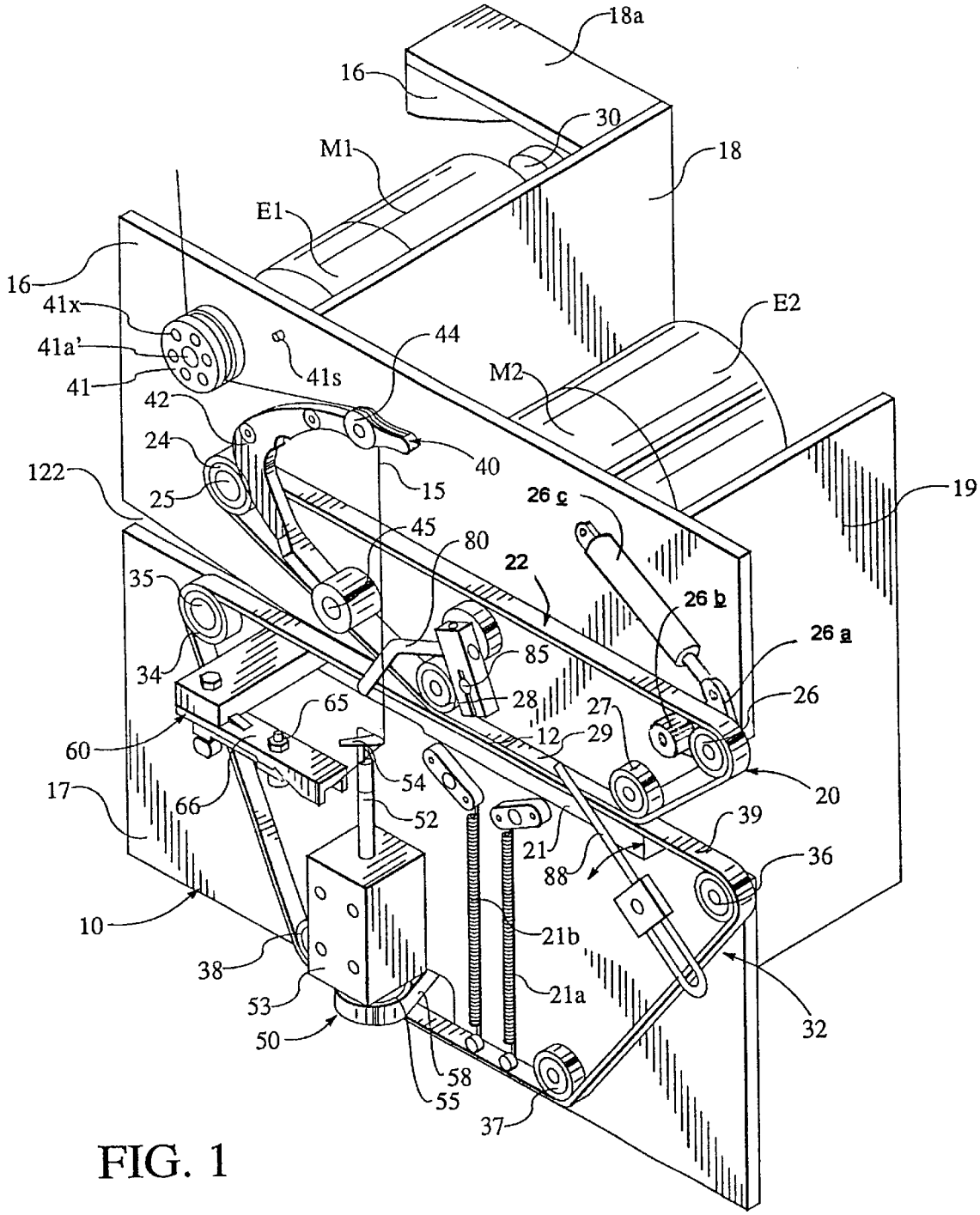
FIG. 1 is a perspective view illustrating the front of the bag neck tying device.
Figure 2:
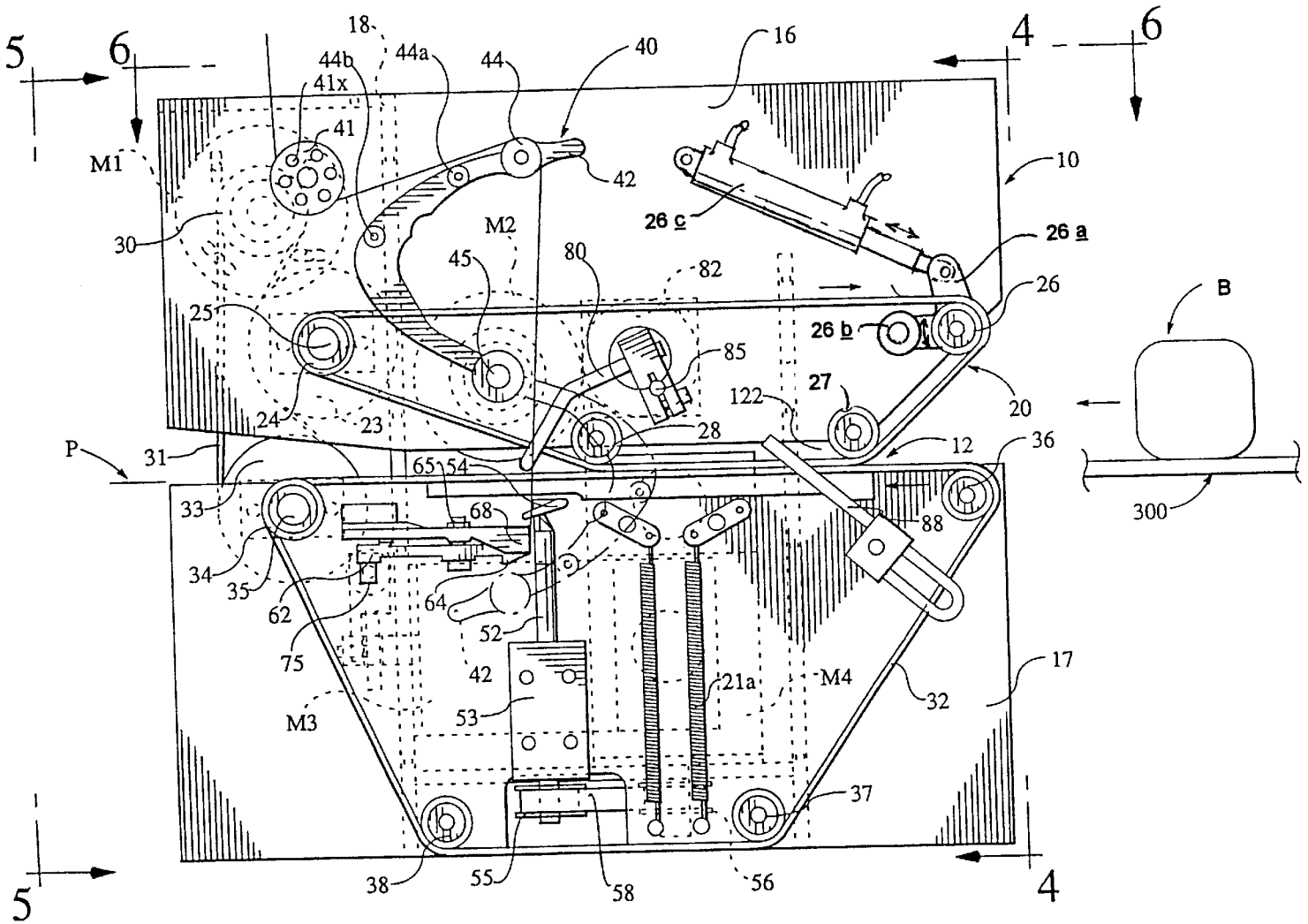
FIG. 2 is a diagrammatic front elevational view.

The wire tying device, generally designated by the numeral 10, in FIGS. 1 and 2 of the drawing is mounted adjacent the side of a conveyor 300 of the type disclosed in U.S. Pat. No. 5,483,134 to Jimmy R. Frazier, John D. Richardson and Greg P. Coxsey entitled "RIBBON SENSING DEVICE FOR BAG TYER," the disclosure of which is incorporated herein by reference in its entirety for all purposes, for tying a flexible bag by attaching and twisting a wire-like ribbon about the neck of the bag. Conveyor 300 carries for example, loaves of bread to, through and out of wire tying device 10 in rapid succession. Conveyor 300 is well known to persons skilled in the art and further description thereof is not deemed necessary except in connection with the drive mechanism as will be hereinafter more fully explained. It should be appreciated that other and further structures may form the conveyor. Improvements is a tag attachment device 100 expand the capabilities of the servo-tyer of the type disclosed in U.S. Pat. No. 5,483,134.

Referring to FIGS. 1 and 2 of the drawing, the numeral 20 generally designates a bag gathering apparatus for moving a bag B along a path 12 to a position adjacent a needle assembly 40, a twister hook assembly 50 and a holder-shear assembly 60. As will be hereinafter more fully explained, the free end of a ribbon of wire-like material 15 is gripped in holder-shear assembly 60. The neck of the bag moves through a slot 122 between upper face plate 16 and lower face plate 17 for drawing the bag B to a controlled tension about the contents thereof. Needle assembly 40 wraps the ribbon 15 of the wire-like material about the gathered neck of the bag and twister hook 50 is actuated for twisting a portion of the wire-like material about the neck of the bag B. It should be noted that the ribbon of material 15 may be constructed of wire enclosed in paper or plastic or it may comprise a ribbon of plastic or any other material. The strand of ribbon 15 extends around one or more pulleys 41, 41*a* and 41*b* mounted on shafts 41*a* from a spool of tie material (not shown).

Figure 7:
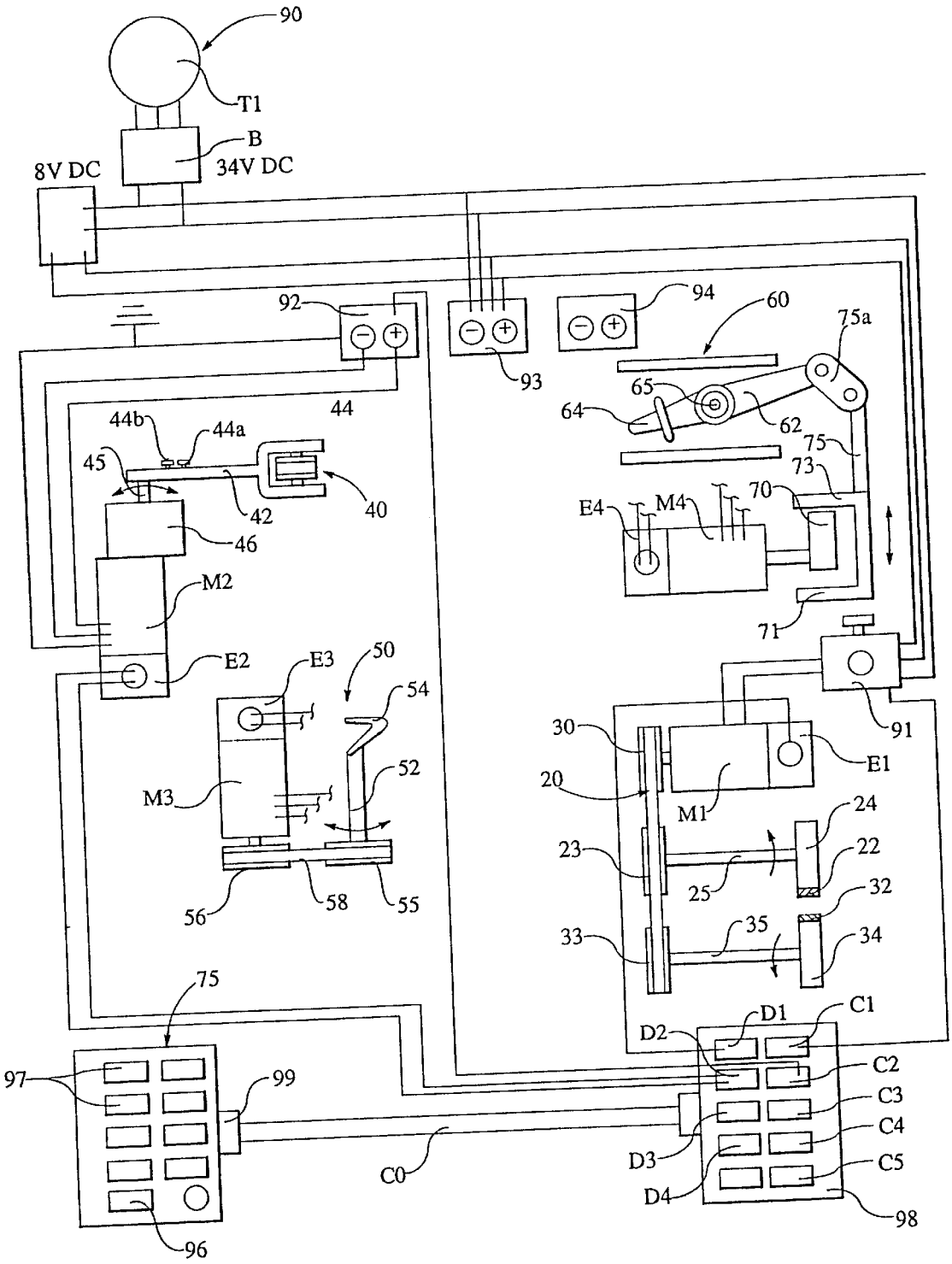
FIG. 7 is a wiring diagram of the closed loop microcomputer controlled control system.

The mounting for the spool is similar to that disclosed in U.S. Pat. No. 3,919,829 entitled "APPARATUS FOR TYING PACKAGES AND WRAPPING MATERIALS", the disclosure of which is incorporated herein by reference in its entirety for all purposes. However, it will be noted that the spool of tie material is mounted on a shaft and tie material 15 is fed from the spool and is routed around rollers 41*b*, 41*a* and 41, around needle roller 44 and the end of the ribbon 15 is gripped in the holder-shear assembly 60, as best illustrated in FIGS. 1 and 7 of the drawing. The spool is mounted on a shaft engaged by a brake (not shown). As needle 42 forms a loop of tie material around the gathered neck of a bag, the force of inertia and force exerted by the brake cause the spool to remain stationary momentarily as a crank arm, on which roller 41*a* is mounted, is rotated in a clockwise direction as illustrated in FIG. 2 of the drawing.

As will be hereinafter more fully explained, one of the pulleys 41, 41*a* or 41*b* is preferably equipped with a sensor device which is capable of calculating the amount of ribbon 15 dispensed from the spool. The sensor apparatus determines whether or not a bag neck is present. As needle 41 moves from the full outline position illustrated in FIG. 2 to the dashed outline position, if a bag neck is not positioned in the path of the ribbon, the cycle of operation will be interrupted so that the holder-shear assembly 60 will not be actuated and the twister hook assembly 50 will not rotate. This prevents actuation of the holder-shear assembly which would have resulted in the ribbon being dropped or released if a bag neck was not present.

The frame of the bag tying device may assume many configurations. In the illustrated embodiment upper and lower face plates 16 and 17 are supported on forward edges of vertically extending end plates 18 and 19 having slots formed therein to permit passage of a bag neck. A horizontal mounting plate 19*a* extends between lower portions of end plates 18 and 19 and a vertical mounting plate 16*a* extends outwardly from end plate 18.

A motor M1, having an encoder E1 mounted the rear end of motor M1, is mounted on an upper portion of the vertical mounting plate 16*a* for driving the gathering assembly 20. A motor M2, having an encoder E2 mounted the rear end and a gear box 46 mounted on the front end of motor M2, is mounted on an upper portion of the rear surface of face plate 16 for driving the needle assembly 40. A motor M3, having an encoder E3 mounted the rear end of motor M3, is mounted vertically on horizontally extending mounting plate 19*a* for driving the twister hook assembly 50. A motor M4, having an encoder E4 mounted the rear end of motor M4, is mounted on a lower portion of end plate 18, and in the illustrated embodiment extends below motor M2, for driving the holder-shear assembly 60.

Referring to FIGS. 1–5 of the drawing, bag neck gathering apparatus 20 comprises, in a preferred embodiment of the invention, an upper gathering belt 22 routed around a driven pulley 24 and idler pulleys 26, 27 and 28. The bag neck gathering mechanism 20 further comprises a lower gathering belt 32 routed around a driven pulley 34 and idler pulleys 36, 37 and 38. As best illustrated in FIG. 1 of the drawing, the portion 29 of the upper gathering belt 22, extending between idler pulleys 27 and 28, is substantially parallel and closely spaced relative to the portion 39 of the lower gathering belt 32 which extends between driven pulley 34 and idler pulley 36. In the illustrated embodiment, gathering belts 22 and 32 move a bag neck along path 12 in a plane P as illustrated in FIG. 2. A pressure pad 21, resiliently urged upwardly by springs 21*a* and 21*b* acting through bell cranks, maintains belts 22 and 32 in frictional engagement with the neck of a bag or other material to be tied.

Figure 3:
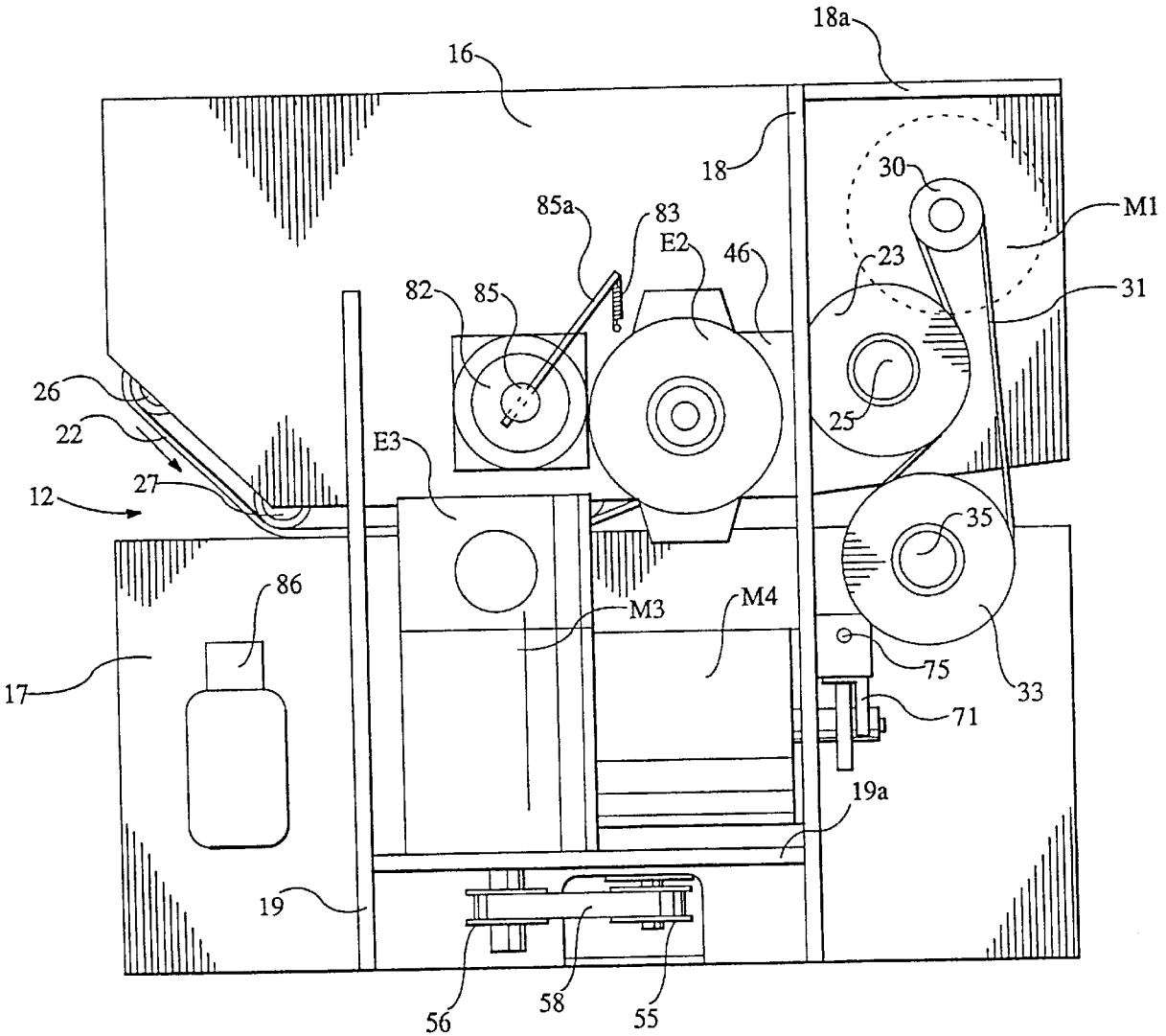
FIG. 3 is a diagrammatic rear elevational view.
Figure 4:
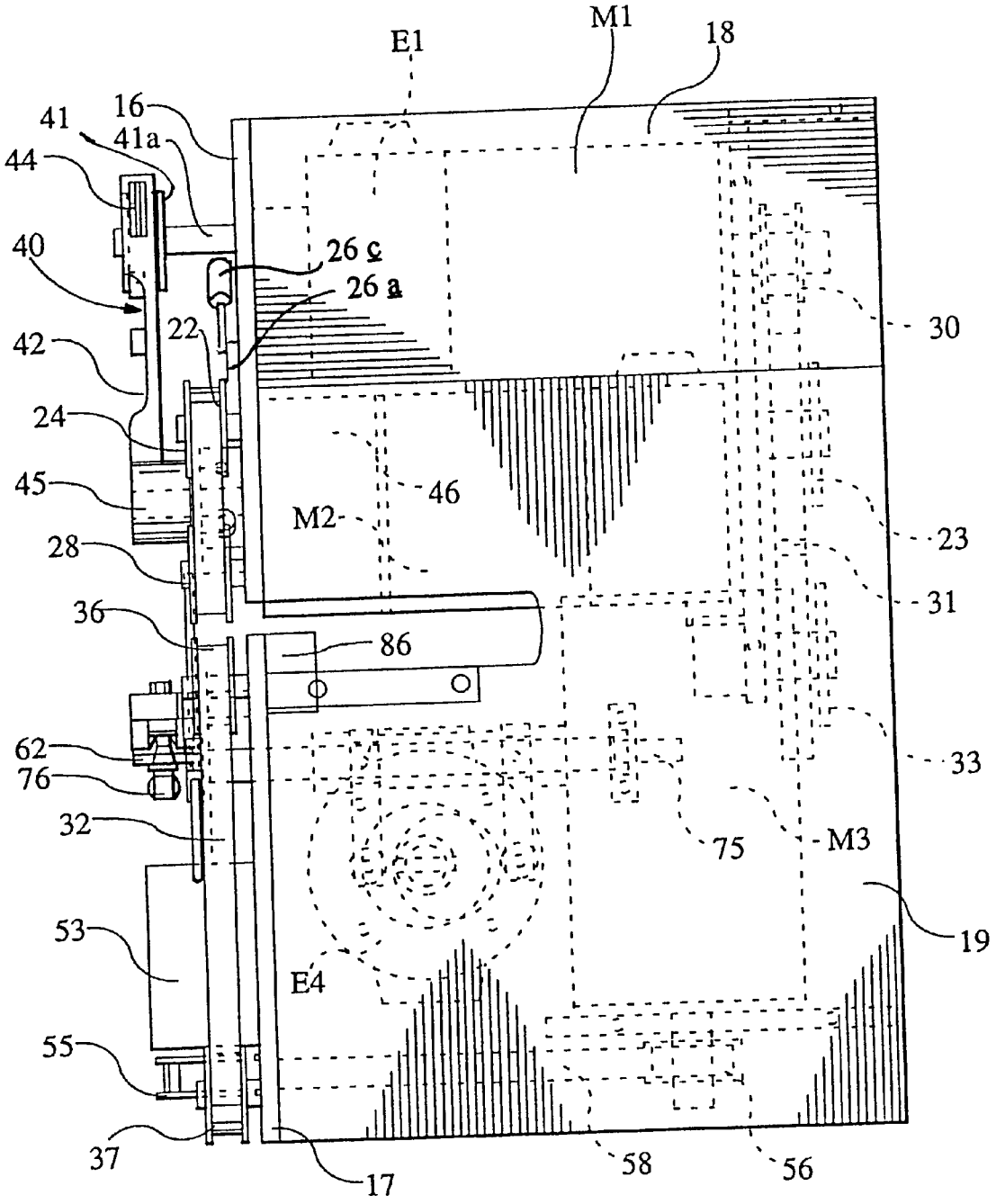
FIG. 4 is an end view looking generally in the direction of the arrows along line 4—4 in FIG. 2.
Figure 5:
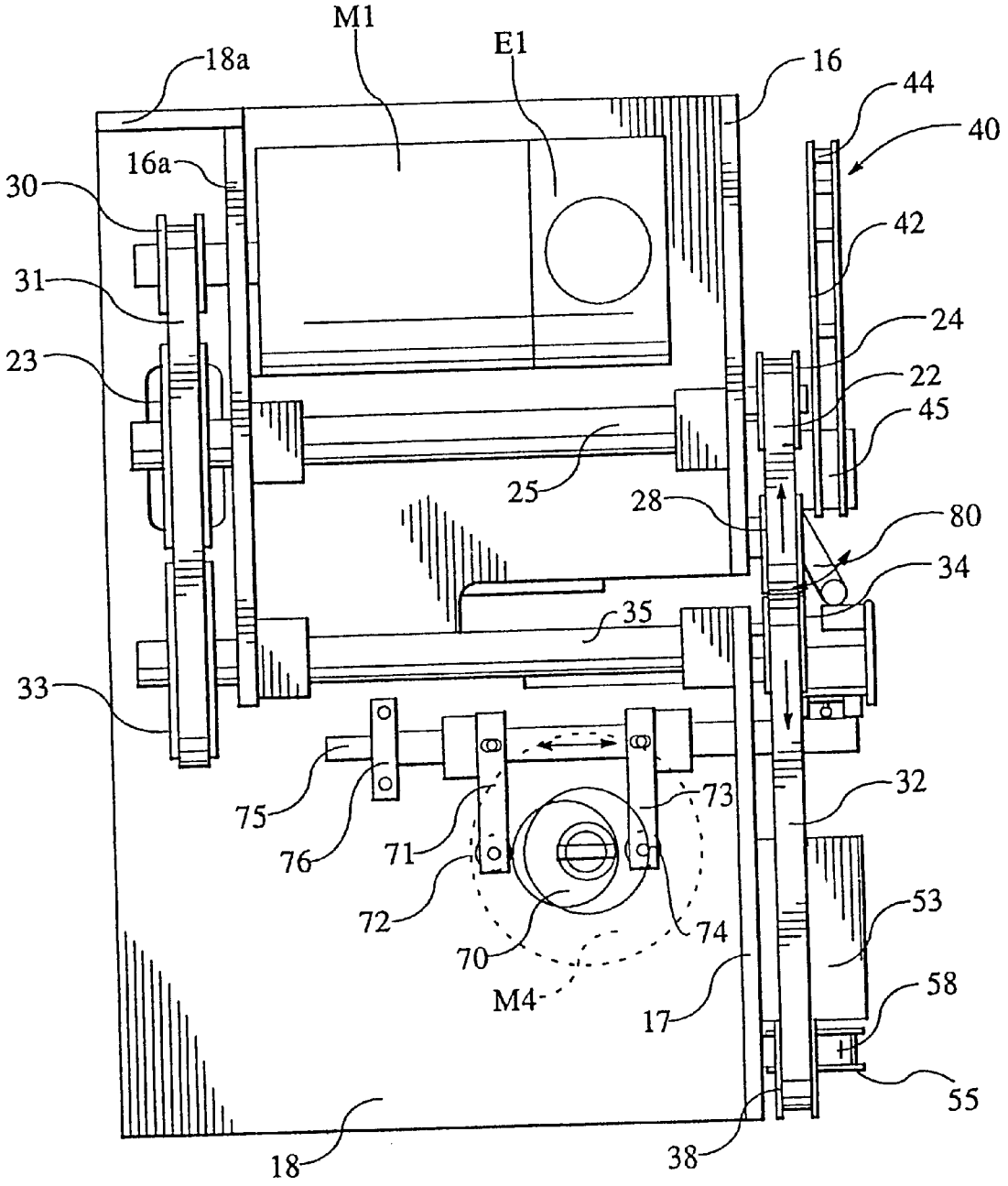
FIG. 5 is a diagrammatic end view illustrating the discharge end of the bag neck tying device, looking in the direction of the arrows along line 5—5 in FIG. 2.
Figure 12:
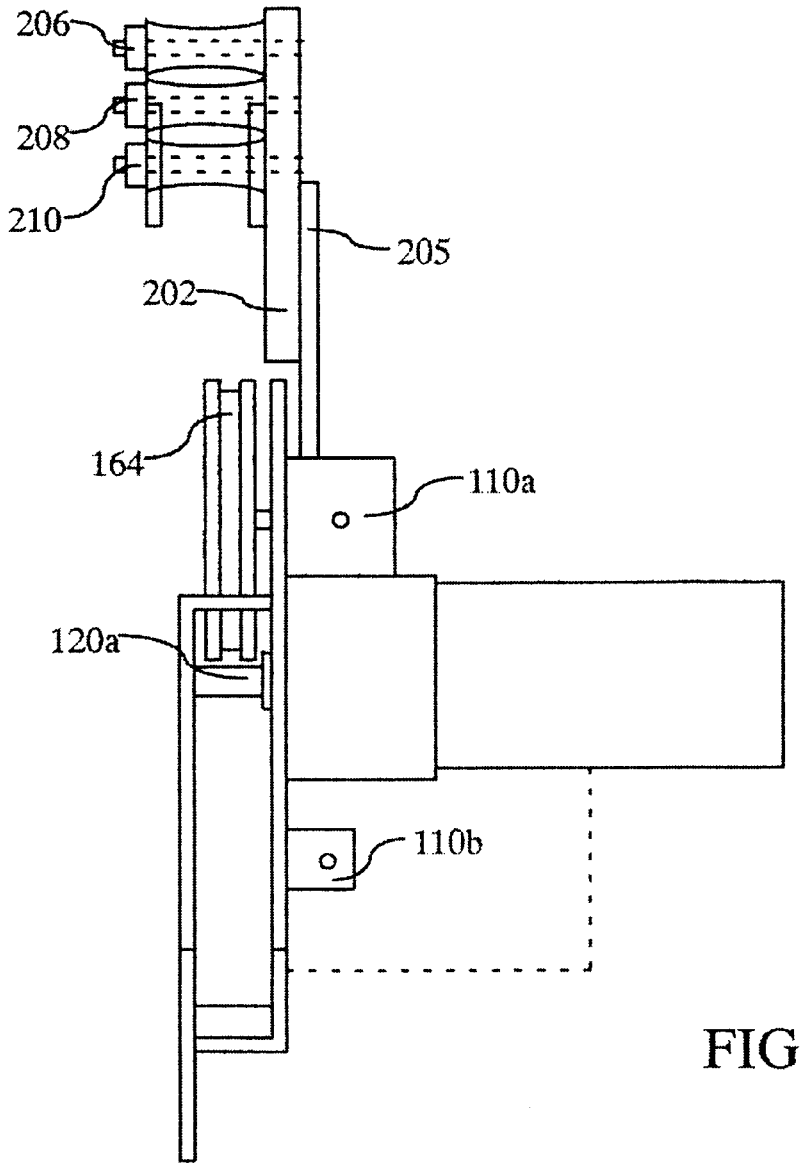
FIG. 12 is an end view of the apparatus illustrated in FIG. 11.

As best illustrated in FIGS. 3 and 5 of the drawing, driven shaft 25, having driven pulley 24 mounted on one end, has a pulley 23 mounted on its opposite end. Driven shaft 35, having driven pulley 34 mounted on one end, has a pulley 33 mounted on its opposite end. A pulley 30 mounted on the drive shaft of motor M1 drives pulleys 23 and 33 through a belt 31 such that driven pulley 24 rotates in a clockwise direction while driven pulley 34 rotates in a counter-clockwise direction, as viewed in FIG. 2 of the drawing. Belt guards 16*a* and 16*b* and 17*a* preferably extend between the gathering belts and products on the conveyor, as illustrated in FIG. 12. The bag neck is moved into a slot in the belt guard by brushes (not shown) and the product in the bag engages the belt guards when the neck of the bag is drawn by gathering belts 22 and 32 around a bag stop lever 80. It should be appreciated that other and further gathering structures may be used to form a gathered neck on a bag.

Terms such as "left," "right," "clockwise," "counter-clockwise," "horizontal," "vertical," "up," and "down" when used in reference to the drawings, generally refer to orientation of the parts in the illustrated embodiment and not necessarily during use. These terms used herein are meant only to refer to relative positions and/or orientations, for convenience, and are not to be understood to be in any manner otherwise limiting.

As illustrated in FIG. 7 of the drawing, motor M1 is driven by a solid state DC motor controller 91 which is capable of varying the speed of motor M1 to substantially synchronize movement of upper gathering belt 22 and lowering gathering belt 33 with the speed of a conveyor 300 moving packages 125 adjacent the bag gathering mechanism 20. For example, if the tier 10 is to gather and tie the necks of 100 bags per minute, the conveyer 300 would preferably bring bags to and through the tier at a speed of approximately 300 feet per minute and the gathering belts 22 and 32 would preferably be driven at a speed of, for example 305 feet per minute, so that the neck of the bag would be accelerated for gathering the neck, stopped momentarily while it is being tied with a ribbon and then discharged in a substantially continuous operation.

As will hereinafter be more fully explained, the gathering assembly 20 also includes a bag stop lever 80, illustrated in FIGS. 2 and 3, mounted on shaft 85 for rotary movement about a horizontal axis, in the illustrated embodiment. Shaft 85 extends through an electric brake 82, which momentarily locks lever 80 in a lowered position extending across path 12 such that gathering belts 22 and 32 move the bag neck into engagement with lever 80. After the bag neck has been gathered and tied, the electric brake 82 is released and the gathered neck, carried between belts 22 and 32, urges the lever 80 upwardly such that it does not obstruct movement of the gathered neck. After the gathered neck passes lever 80, the lever 80 moves back to the illustrated position extending across path 12.

A needle assembly 40, best illustrated in FIGS. 1–4 and 7, is positioned for wrapping a strand 15 of ribbon material around a gathered neck of a bag. The needle assembly 40 comprises a needle 42 carrying idler rollers 44, 44*a* and 44*b*. The needle 42 is mounted on the output shaft 45 of a gear box 46 driven by motor M2. Needle 42 is shown in its home position in FIGS. 1 and 2 of the drawing. Motor M2 moves needle 42 from the full outline position to the dashed outline position, illustrated in FIG. 2 of the drawing, and then reverses for moving the needle 42 back to the position illustrated in full outline in FIG. 2.

Referring to FIGS. 1, 3 and 7 of the drawing, a twister hook assembly 50 comprises a twister shaft 52 rotatably mounted in a bearing 53 having a hook 54 on one end thereof and a pulley 55 on the other end. A drive pulley 56 is mounted on the drive shaft of motor M3 and drives pulley 55 through a belt 58.

As best illustrated in FIGS. 1, 2, 5 and 7 of the drawing, a ribbon holder-shear assembly, generally designated by the numeral 60, comprises a holder and shear assembly of the type disclosed in U.S. Design Pat. No. 307,281 to Charles E. Burford and U.S. Pat. No. 4,856,258 entitled WIRE TYING DEVICE, which issued Aug. 15, 1989, to Charles E. Burford and Jimmy R. Frazier. The holder-shear assembly 60 comprises a gripper arm 62 having a gripper finger 64 on one end thereof rotatably secured to a mounting plate 66 by bolt 65. A pair of anvils 68 and 69 are formed on the end of mounting plate 66, each being associated with shear surfaces 68*a* and 69*a* to grip and cut a strand of ribbon as will be hereinafter more fully explained.

Referring to FIGS. 5 and 7 of the drawing, a cam 70 is mounted on the shaft of motor M4 and is configured to engage cam-followers 72 and 74 on spaced arms 71 and 73 secured to and actuating rod 75 mounted for reciprocating movement in bearings 76. A link 75*a* secures the end of gripper arm 62 to actuating rod 75.

It should be readily apparent when the shaft of motor M4 rotates one-half revolution, cam 70 will exert force through cam-followers 72 and 74 for moving actuating rod 75 for pivoting the actuating arm 62 about bolt 65. The free end of the ribbon is gripped between the end of gripper finger 64 and anvil 68 or 69, depending on which direction the gripper finger 64 is shifted. As will be hereinafter more fully explained, when needle 42 wraps the intermediate section of the ribbon 15 around the gathered neck of a bag, the ribbon will be positioned between gripper finger 64 and the other anvil 68 or 69. When gripper finger 64 is shifted to its opposite position, the ribbon will be cut and the free end of the strand of ribbon will be gripped between gripper finger 64 and anvil 68 or 69.

Figure 13:
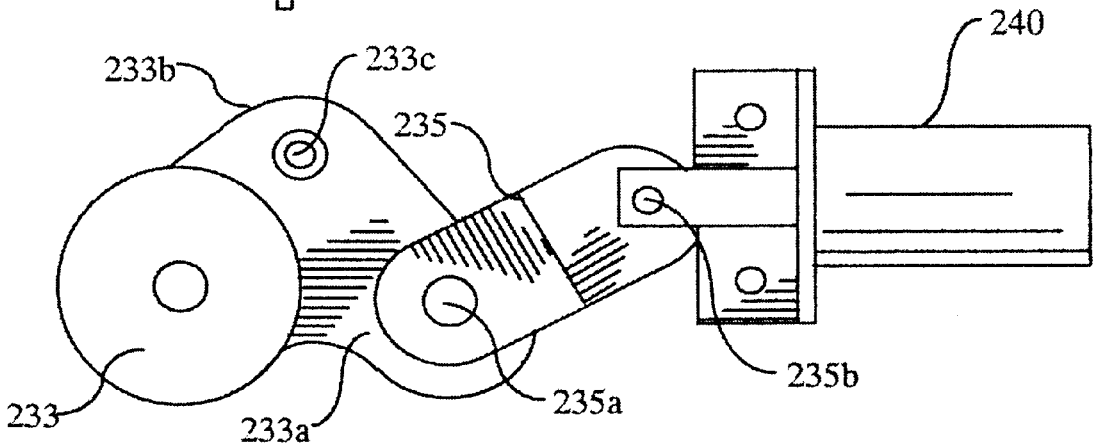
FIG. 13 is an enlarged diagrammatic view of a solenoid actuated feed roller.

Referring to FIGS. 12 and 13 of the drawing, roller 41 has a plurality of index points 41*x*. In the illustrated embodiment, the index points are formed by steel dowel pins circumferentially spaced around the axis about which roller 41 rotates.

A proximity switch 41*s* is positioned near index pointers 41*x* for making an electrical circuit when the presence of an indexing pin 41*x* is sensed. The proximity switch 41*s* is of conventional design and is connected through a suitable power supply and amplifier to the CPU 96.

Thus, the CPU monitors the proximity output and counts the pulses produced by index pins 41*x* in roller 41. The CPU 96 calculates the amount of ribbon dispensed to determine whether or not a bag neck is present as needle 42 moves from the full outline position illustrated in FIG. 2 of the drawing toward the dashed outline position illustrated in FIG. 2 of the drawing. If needle 42 did not wrap ribbon around a bag neck, the CPU will terminate a portion of the remainder of the cycle of operation so that holder-shear 65 will not be actuated to prevent releasing the end of ribbon 15 which is gripped between gripper finger 64 and anvil 68 or 69.

Referring to FIGS. 1, 2 and 3 of the drawing, a bag stop lever 80 is mounted on a shaft 85 for rotary movement about a horizontal axis. Shaft 85 extends through an electric brake 82 and has a crank arm 85*a* secured thereto which is resiliently urged in a clockwise direction, as viewed in FIG. 3, by a spring 83.

A switch 86 is actuated by switch arm 88, which actuates a timer for energizing electric brake 82 which momentarily locks bag stop 80 in a fixed position for a predetermined period of time, for example 0.25 seconds for restraining the leading edge of a bag neck, such that gathering belts 22 and 32 will gather the neck adjacent bag stop 80. Switch 86 also triggers a cycle of operation of the tag attachment device 100. At the expiration of the predetermined period of time, electric brake 82 will be de-energized so that linear movement of the bag neck will rotate bag stop 80 upwardly to release the bag so that it will be moved away by the conveyor. Bag stop 80 is biased toward the position illustrated in FIG. 3 of the drawing by a spring 83. It should be readily apparent that the spring 83 may be replaced by a counter-weight, air cylinder or other suitable biasing mechanism to resiliently urge bag stop 80 toward its home position.

Motors M1, M2, M3 and M4 are bi-directional, permanent magnet, DC brush-type servomotors having outputs proportional to the voltage applied across the armatures. Such motors are commercially available from Groschopp, Inc. of Sioux Center, Iowa as a "Power Master 8304" 24 volt DC continuous power motor. At 1500 rpm the motor generates 16 oz-in torque and has an output of 0.090 horsepower at 4.2 amps. At 2450 rpm the torque is 47 oz-in and the output is 0.113 horsepower at 5 amps. At 5400 rpm the torque is 37 oz-in and the output is 0.197 horsepower at 8.2 amps.

It is noted that other motors and motors of other sizes may be provided to facilitate driving the various assemblies. For example, it is contemplated that smaller motors would be used in a counter top model used for gathering and fastening materials such as coils of electrical cord, water hose, tubing, or yarn, and bundles of cable, rods, or carrots and other produce.

One side of the armature winding of each motor M1, M2, M3 and M4 is connected to ground such that reversing the polarity of current through the armature winding reverses the direction of rotation of the motor.

Each of the motors M1, M2, M3 and M4 has an encoder E1, E2, E3 or E4 mounted on its drive shaft which delivers an electrical signal to a decoder D1, D2, D3 or D4 which is representative of the position of the motor shaft.

Referring to FIG. 7 of the drawing, the numeral 90 generally designates a power supply for delivering electric current to motor controller 91 and to motor M1 in the bag neck gathering mechanism 20; motor controller 92 and motor M2 in the needle assembly 40; motor controller 93 and motor M3 in the twister assembly 50; and motor controller 94 and motor M4 in the holder-shear assembly 60. The power supply 90 comprises a pair of single-phase, doughnut transformers T1 connected in parallel. The supply or primary circuits of transformers T1 are connectable to any suitable source of electricity such as 115 volt, 60 cycle, single-phase electricity. The energy receiving or secondary circuits of transformers T1 are connected through one or more rectifier bridge circuits B1 and B2 and capacitors C6 and C7 to a pair of controlled voltage power terminals, one of which forms a source of direct current maintained at positive 34 volts and the other a source of direct current at negative 34 volts.

The 34 volt and 8 volt power supplies illustrated in FIG. 7 is of conventional design and form no part of the present invention except in combination with the other elements of the control circuit. It should be appreciated that many other DC power supplies may be used in lieu of those illustrated in the drawing.

Conventional multichannel incremental optical encoders E1, E2, E3 and E4 are mounted on the shaft of each motor M1, M2, M3 and M4, respectively. The encoders E1–E4 are high resolution incremental optical devices which include an encoder body, a metal code wheel and emitter end plate. An LED source and lenses transmit collimated light from the emitter diode through a precision metal code wheel and phase plate into a bifurcated detector lens (not shown).

The light is focused onto pairs of closely spaced integrated detectors which output two square wave signals in quadrature and an optional index pulse.

HEDS-6000 series, two and three channel incremental optical encoder kits are available from Hewlett Packard of Palo Alto, Calif. A standard selection of shaft sizes and resolutions between 192 and 1024 cycles per shaft revolution are available. The part number for a standard two-channel encoder is HDS-6000, while that for the three-channel device, with index pulse, is HEDS-6010. The encoder devices are typically used for printers, plotters, tape drives, positioning tables, automatic handlers, robots, and other servo loop applications. Specific details of construction of the incremental optical encoder can be found in Hewlett Packard Publication No. 5954-8420 (3/87) which is incorporated herein by reference.

The incremental shaft encoder operates by translating the rotation of a shaft into interruptions of a light beam which are then output as electrical pulses. The light source is a light emitting diode collimated by a molded lens into a beam of parallel light. An emitter end plate contains two or three similar light sources, one for each channel.

The code wheel is a metal disc that has N equally spaced slits around its circumference. An aperture with a matching pattern is positioned on a stationary phase plate. The light beam is transmitted only when the slits in the code wheel and the aperture line up; therefore, during a complete shaft revolution, there will be N alternating light and dark periods. A molded lens beneath the phase plate aperture collects the modulated light into a silicon detector.

The encoder body contains the phase plate and the detection elements for two or three channels. Each channel consists of an integrated circuit with two photo-diodes and amplifiers, comparator, and output circuitry (not shown).

The apertures for the two photo-diodes are positioned so that a light period on one detector corresponds to a dark period on the other. The photo-diode signals are amplified and fed to a comparator whose output changes state when the difference of the two photo currents changes sign. The second channel has a similar configuration but the location of its aperture pair provides an output which is in quadrature to the first channel (phase difference of 90°). Direction of rotation is determined by observing which of the channels is the leading waveform. The outputs are TTL logic level signals.

The motion sensing application and encoder interface circuitry will determine the need for relating the index pulse to the main data tracks. A unique shaft position is identified by using the index pulse output only or by logically relating the index pulse A and B data channels. The index pulse can be uniquely related to the A and B data tracks in a variety of ways. State width, pulse width or edge transitions can be used.

The two square wave signals in quadrature of channels A and B and a 5 volt supply input are delivered through a 10-pin connector to a corresponding decoder D1, D2, D3 or D4 mounted on an auxiliary board, as illustrated in FIG. 7 of the drawing. Lines connecting encoders E2 to a decoder D2 are illustrated. Encoders E3 and E4 are similarly connected to decoders D3 and D4.

Quadrature decoders D1–D4 are CMOS (complimentary metal-oxide semiconductor) integrated circuits that perform the quadrature decoder, counter, and bus interface functions. "HTCL-2000," commercially available from Hewlett Packard, quadrature decoder/counter interface IC decoder interfaces an encoder to a microprocessor and is designed for use in digital closed loop motion control systems and digital data input systems.

The decoder includes a 4× quadrature decoder, a binary up/down state counter and a 16-bit bus interface. A Schmitt-triggered CMOS input and input noise filters are incorporated in the device.

Further information regarding the quadrature decoder/counter interface IC for interfacing to Motorola and Intel microprocessors can be found at page 1–61 through page 1–76 of Hewlett Packard Publication for "HCTL-2000," "HCTL-2016," "HCTL-2020."

Decoders D1–D4 have pins for a channel A and channel B Schmitt-trigger inputs which accept the outputs from quadrature encoders E1–E4. The two channels are preferably 90° out of phase.

Figure 6:
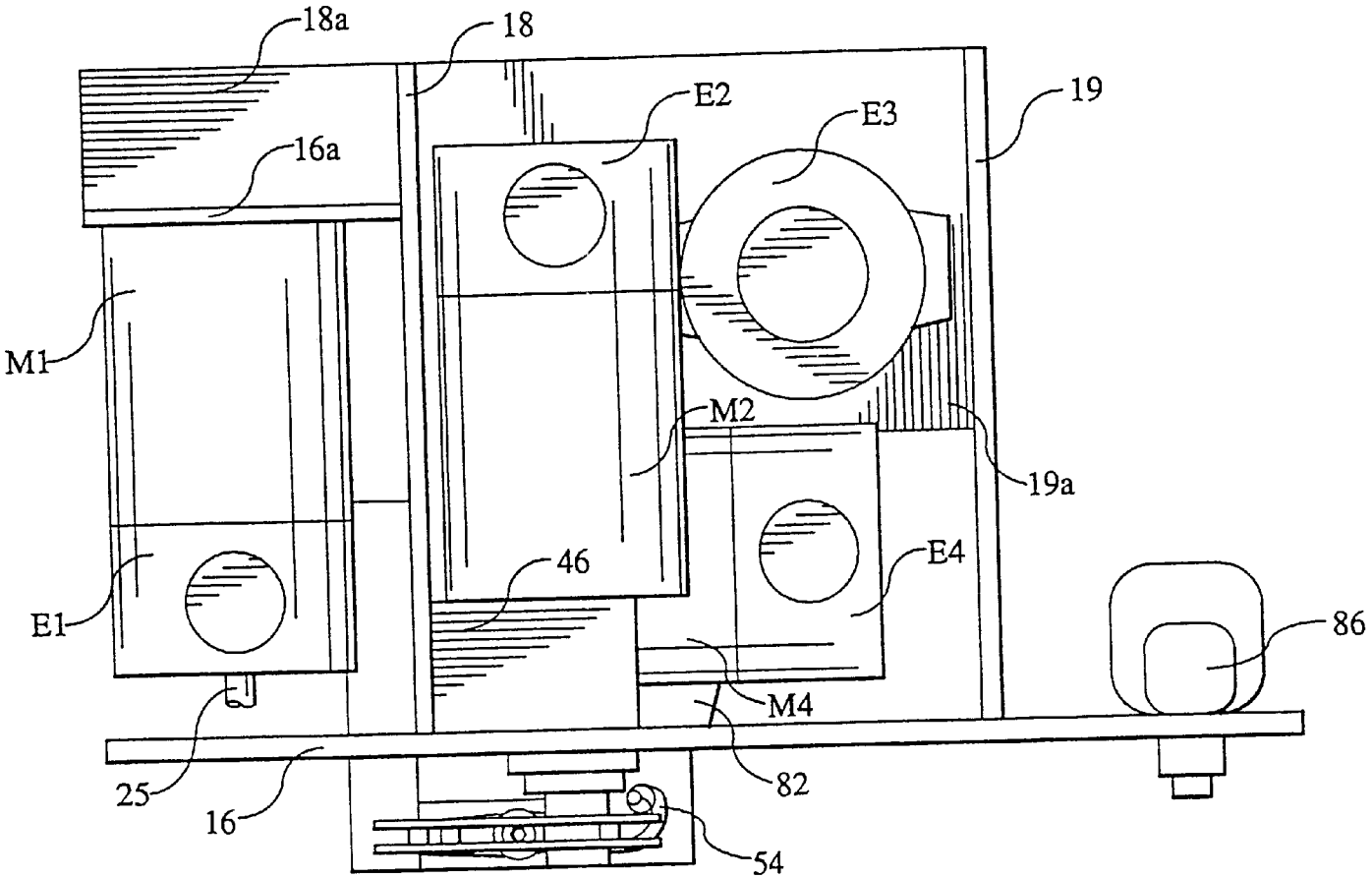
FIG. 6 is a top plan view, looking in the direction of the arrows along line 6—6 in FIG. 2, parts being broken away to more clearly illustrate the details of construction.

The system is controlled by a computer 95, illustrated in FIG. 6, which receives and stores a set of instructions and then acts upon the instructions in a predetermined and predictable fashion. A microprocessor 96 is attached to a printed circuit board into which a thin layer of metal has been applied and then etched away to form traces. The electronic components of the central processing unit are attached to the board with solder so that they can change electronic signals through the etched traces on the board.

A suitable 32-bit integrated microcontroller 96 is the MC68332 which is commercially available from Motorola, Inc. of Schaumburg, Ill. as a product referred to as "MC68332 SIM" System Integrated Module. A complete documentation package of the MC68332 consists of the (SIM 32UM/AD), MC68332 *System Integration Module User's Manual,* the (CPU32RM/AD), CPU32 *Reference Manual*, and the TPU32RM/AD), *Time Processing Unit Reference Manual.* The MC68332 *System Integration Module User's Manual* describes the capabilities, registers, and operation of the MC68332 MCU. The *CPU Reference Manual* describes the operation, programming and instruction set of the CPU32 processor used in the MC68332. The *Time Processing Unit Reference Manual* describes the autonomous timer system used in the MC68332.

The MC68332 microcontroller 96 contains intelligent peripheral modules such as the time processor unit (TPU) which provides 16 microcoded channels for performing time-related activities for simple input capture or output capture to complicated motor control or pulse width modulation. High-speed serial communications are provided by the queued serial module (QSM) with synchronous and asynchronous protocols available. Two kilobytes of fully static standby RAM allow fast two-cycle access for system and data stacks and variable storage with provision for battery backup. Twelve chip selects enhance system integration for fast external memory or peripheral access. These modules are connected on-chip via an intermodule bus (IMB).

The MC68332 microcontroller 96 is a 132-pin plastic quad flat pack that operates at a frequency of 16.78 MHZ with a 5 volt supply and is software programmable. It has 16 independent programmable channels and pins. Any channel can perform any time function including input capture, output compare or pulse width modulation (PWM).

The detailed logical procedures or algorithms processed by the microcomputer are proportional integral derivative (PID) type control mode signals. The PID control mode combines the best action of proportional control, integral control and derivative control in a closed loop control system.

In addition to the microcontroller chip 96 on the CPU board, random-access memory (RAM) integrated circuits 97 are used for storing values in distinct locations which can be recalled or altered for storing the software which controls the system. Since the values which are in RAM memory are lost when the power of the computer is turned off, a battery backup is provided. The microcontroller 96 processes digital signals, such as the presence or absence of voltages, to represent values.

The CPU board is connected to an auxiliary board 98 through a connector header which carries data signals and address signals. Driver circuits C1–C4, which generate pulse width modulated (PWM) signals, are mounted on the auxiliary board along with the decoders D1–D4. The pulse width modulated signals from driver circuits C1–C4 are sent to the motor drivers 91–94 selectively delivering positive or negative DC power to control the operation of motors M1–M4.

The circuits carrying input signals from the encoders E1–E4 to decoders D1–D4; the circuit carrying pulse width modulated signals from driver circuits C1–C4 to motor drivers 91–94; and the circuits carrying power from the motor drivers 91–94 to motors M1–M4 form a closed loop control system. The closed loop control system depends upon the feedback concept for operation and the output PWM signals are forced to a preassigned function of the reference input of the microcontroller of the central processing unit. The microcontroller 96 sends control PWM signals determined by the programmed movements stored in RAM memory in a pre-assigned order as a function of time after switch arm 88 returns to its home position illustrated in FIG. 3. The control PWM signals are delivered to the control circuit. Each encoder E1–E4, connected to the shaft of motors M1–M4, send quadrature signals to the decoders D1–D4 that indicate the position of the shaft of each motor. The control PWM signals delivered to each control circuit C1–C4 are delivered to motor drivers 91–94. The quadrature signals from decoders D1–D4 are read to adjust the control PWM signals.

Drivers 92, 93 and 94, which control the delivery of power to motors M2, M3 and M4, respectively, for controlling the needle assembly 40, twister hook assembly 50 and holder-shear mechanism 60 are substantially identical. One side of the winding of each of the motors M2, M3 and M4 is connected to ground. Drivers 92, 93 and 94 deliver either positive or negative power to the other side of the motor winding for driving motors M2, M3 and M4 in opposite directions. For example, when positive 34 volt direct current is delivered to the winding of motor M2, its shaft is driven in a clockwise direction. If negative 34 volt direct current is delivered to the winding of motor M2, its shaft will be driven in a counter-clockwise direction.

The driver 91 for motor M1 connected to the bag gathering assembly 20, is similar to drivers 92, 93 and 94 except that driver 91 is not provided with the capability of delivering negative direct current because it is not necessary for motor M1 to be driven in reverse.

Figure 11:
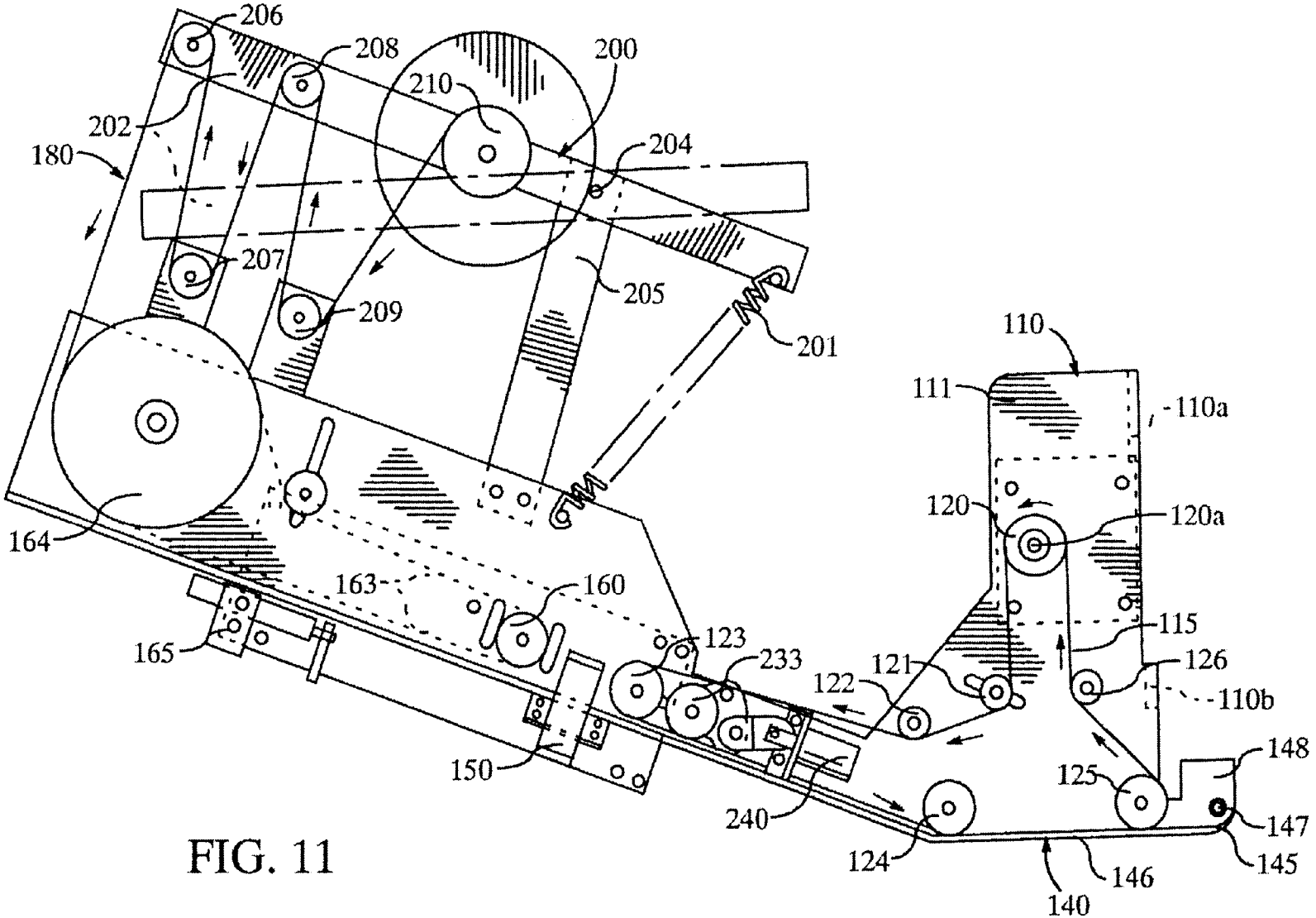
FIG. 11 is a diagrammatic elevational view similar to FIG. 9 of a second embodiment.

Software is stored in FEEPROM memory on the CPU board for controlling the acceleration, speed and position of the shaft of each motor M1–M4. FIG. 11 is a graphic representation of the sequence of operation of the needle, hook and shear assemblies during a complete cycle of operation. The microcontroller 96 is initially programmed by a computer through a serial port RS for storing a program which will initiate movement of needle 42 from its home position illustrated in FIG. 3 and the speed of movement toward the dashed outline position illustrated in FIG. 3 controlled by signals delivered through control circuit C2 to motor M2. While needle 42 is moving from the position illustrated in full outline toward the position illustrated in dashed outline, the program causes a signal to be sent from control circuit C3 to motor M3 to begin rotating twister hook 54 and continue rotation of twister 54 a predetermined number of revolutions controlled by the motion profile in RAM memory. Similarly, when needle 42 and twister hook 54 are in predetermined positions, a signal will be sent from driver circuit C4 which will energize motor M4 for rotating cam 70 to move the gripper finger 64 to release the free end of the ribbon and shear a segment from the end of the strand of ribbon. At a time controlled by the software, a signal will be delivered to motor M2 for moving needle 42 from the position shown in dashed outline in FIG. 3 back to its home position. A signal will be delivered to motor M3 for rotating twister hook 54 two revolutions in the reverse direction for slinging the tie, which has been twisted around the neck of a bag, out of the twister hook 54 for completing a tying cycle.

It should be readily apparent that when the neck of a bag moves between gathering belts 22 and 32, switch arm 88 will be moved downwardly from the position illustrated in FIG. 3 which will energize electric brake 82 so that belts 22 and 32 will move the neck of the bag into engagement with bag stop 80 causing the neck to be gathered. As the trailing edge of the neck of the bag passes over the end of switch arm 88, switch arm 88 will move back to the position illustrated in FIG. 3 causing switch 86 to send a signal to the microcontroller for starting a new tying cycle.

Figure 9:
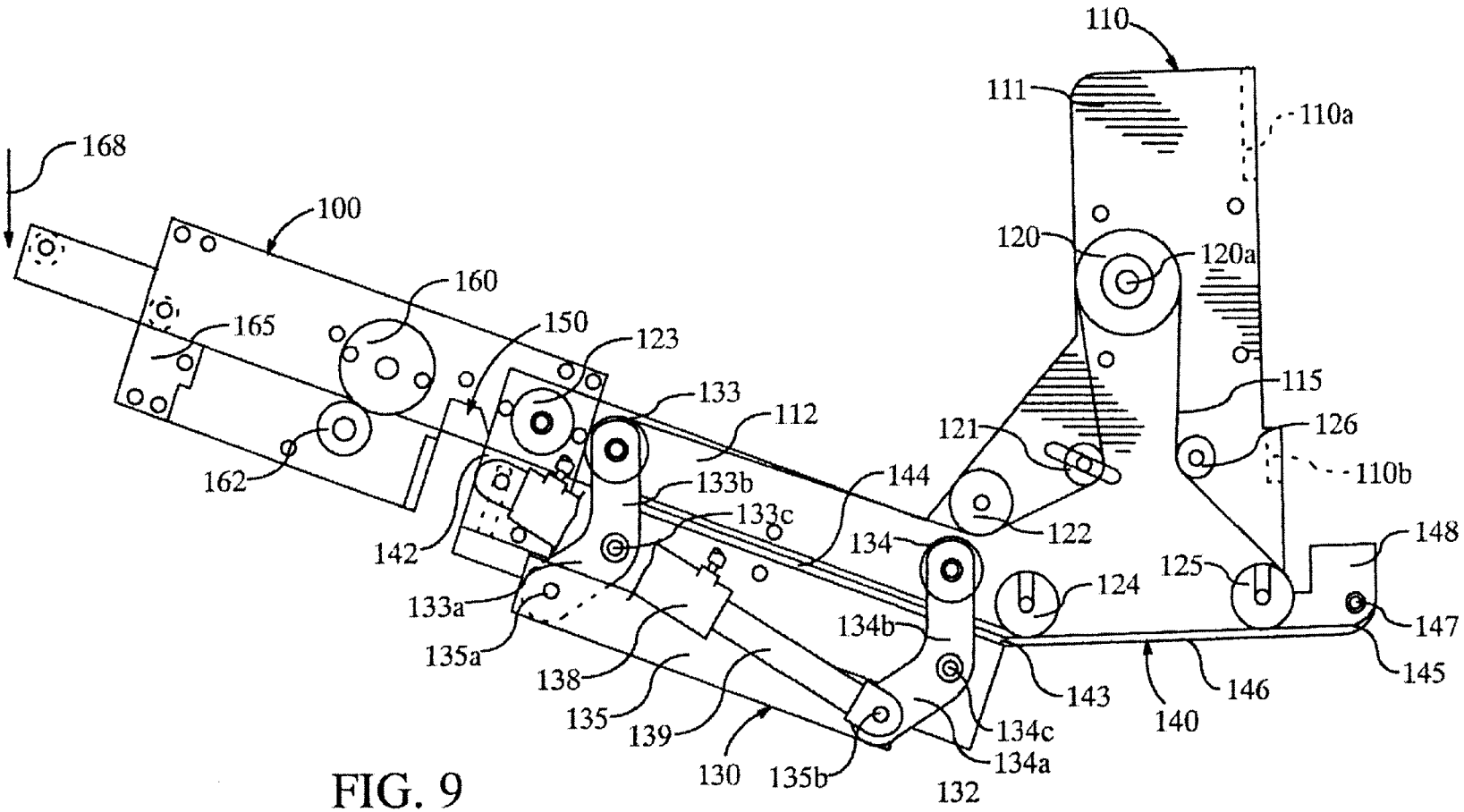
FIG. 9 is a diagrammatic elevational view of the tag attachment device.

Referring to FIG. 9 of the drawing the numeral 100 generally designates a tag attachment device having a frame 100 formed by a generally vertically extending frame portion 111 and a generally horizontally extending frame portion 112. A driven roller 120 is mounted on the shaft 120*a* of an electric motor 120*b*. Idler pulleys 121, 122, 123, 124, 125 and 126 are rotatably mounted on frame plate 110. A tag feed belt 115 extends around and is driven by driven roller 120 in a counter-clockwise direction as viewed in FIG. 9 of the drawing around idler rollers 121, 122, 123, 124, 125 and 126. It should be noted that idler rollers 121, 124 and 125 are mounted on shafts extending through slots in frame plate 110 to permit adjustment of the position of the rollers for controlling belt tension and frictional force exerted on a tag, as will be hereinafter more fully explained.

Feed rollers 133 and 134 are mounted in a parallel linkage mechanism 130. A bell crank having arms 133*a* and 133*b* supports roller 133 and is pivotally secured to a mounting plate 132 by a pin 133*c*. Roller 134 is mounted on a bell crank having arms 134*a* and 134*b* pivotally secured by a pin 134*c* to mounting plate 132. A link 135 has opposite ends secured by pins 135*a* and 135*b* to arms 133*a* and 134*a* of the bell cranks such that the bell cranks move in unison and move rollers 133 and 134 into and out of engagement with belt 115. The rod 139 of an air cylinder 138 is preferably connected to pin 135*b* for actuating the parallel linkage mechanism 130 for feeding tags through the system, as will be hereinafter more fully explained.

A guide plate generally designated by the numeral 140 has an inclined section 144 between end 142 and deflected portion 143 and a generally horizontally extending portion 146 between deflected portion 143 and curved guide surface 145. When a tag is positioned on end 142 of guide plate 140, it will be moved by belt 115 when the parallel linkage mechanism 130 is actuated for moving the tag downwardly along portion 144 and along portion 146 through a slot 147 between holder pin 148 and curved guide surface 145.

Belt 115 is preferably driven continuously. When cylinder 138 is actuated, rod 139 is extended which rotates the bell cranks carrying rollers 132 and 134 simultaneously into engagement with belt 115. As will be hereinafter more fully explained, an electric eye 165 senses the position of tags for controlling actuation of double acting cylinder 138 for raising and lowering rollers 133 and 134.

A cutter 150 is mounted adjacent end 142 of guide plate 140 for severing individual tags from a series of tags. A driven roller 160 and an idler roller 162 form a nip adjacent opposite sides of a continuous series of tags for drawing the strip of tags through tag entry area 186, adjacent to electric eye 165 into the nip between rollers 160 and 162. The strip of tags is pushed through cutter 150 into space between belt 115 and guide plate 140.

Figure 10:
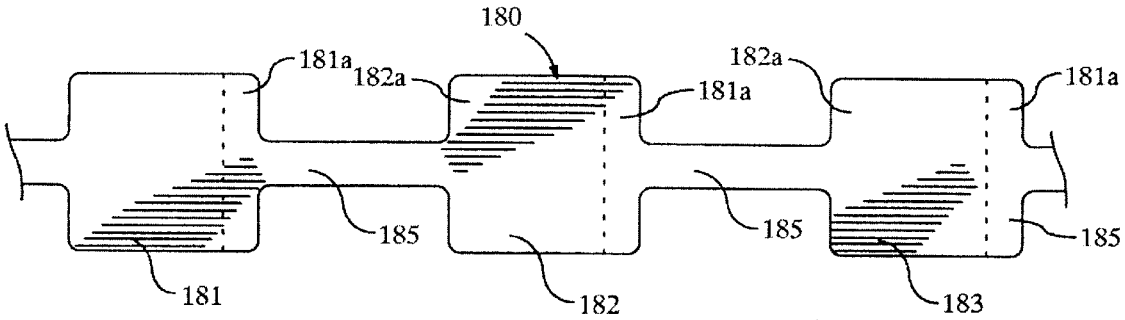
FIG. 10 is a fragmentary elevational view of a strip of tags.

Strip 180 of tags, as illustrated in FIG. 10, comprises a series of tags 181, 182 and 183 joined by connectors 185. Cutter 150 cuts through tags 181, 182 and 183 to form a body portion 182*a* on one end of connector 185 and a tail piece 181*a* on the other end of connector 185.

Referring to FIG. 10 of the drawing, tags in a continuous strip 180 are supplied on a roll or spool mounted on a spool holder 186. The spool holder includes a spring clutch for holding tension on the strip 180 as tags are unrolled from the roll. The spring clutch includes a backup feature that backs up the roll approximately ¼ to ½ turn for taking up any backlash that might occur as the roll stops. The spool holder preferably has transparent sides to keep the roll of tags straight and to guide them as they unroll from the spool.

The continuous strip 180 extends into the entry area 168 of tag attachment device 100, as best illustrated in FIG. 9 of the drawing. The tag entry area is preferably formed by a pair of side guide members for controlling the tag position laterally and an entry rod under which the tags pass for aligning the tags. It should be readily apparent that the entrance angle of the strip 180 into the tag entry area will vary as the diameter of the spool decreases as tags are used.

As best illustrated in FIG. 9 of the drawing, electric eye 165 is positioned to sense the position of the tags. Each tag has a black mark or other indicia thereon so that the photo eye can sense the relative position of each tag. The position of the photo eye 165 can be adjusted so that the distance between the mark and the cutter 150 can vary.

Pinch rollers 160 and 162 and cutter 150 are arranged to form a tag drive and cutting area. A clutch and brake control connected to drive roller 160 allow pinch rollers 160 and 162 to stop and start when demanded by the trigger switch 86 actuated when the neck of a bag engages switch arm 88.

Cutter 150 is a dual blade rotating cutter that allows tag stock to travel through the cutter and to cut with 180° rotation of the dual blade. The clutch, brake and pinch roller bearings are mounted in a tag drive box.

As hereinbefore described, the tag feed area adjacent end 142 of guide plate 140 allows a cut tag to be fed to the front of the servo tyer. The feed area moves the tag by pinching the tag between rubber belt 115 and the inclined portion 144 of guide plate 140. Before a tag is cut along the dotted line, illustrated in FIG. 10, belt 115 is held up out of engagement with the strip of tags. After a tag has been cut, piston rod 139 of cylinder 138 is extended pushing belt 115 toward portion 144 of guide plate 140 to pinch the tag and drive the tag to a holding area adjacent curved end 145 of guide plate 140.

The portion of guide plate 140 between roller 125 and holder pin 148 bridges gathering belt 22 between rollers 26 and 27 so that movement of the rod of pressure actuated cylinder 26*c* will rotate bell crank 26*a* about pin 26*b* for moving pulley 26 toward guide plate 140. The connector 185 between tag 182 and tail 181*a* will be engaged by belt 22 and wiped laterally with the bag neck away from the tag attachment device 100.

Figure 8:
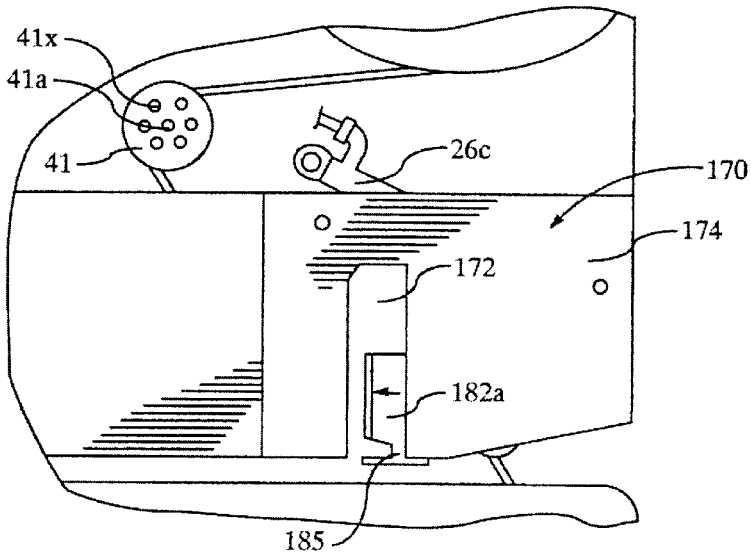
FIG. 8 is an enlarged elevational view similar to FIG. 2.

As illustrated in FIG. 8 of the drawing, cover 170 is formed by a back plate 172 secured to a cover plate 174 for forming a pocket into which the body portion 182*a* of the tag extends when it passes under holder pin 148 and is deflected upwardly by curved portion 145 of guide plate 140. The body portion of the tag moves through an entrance slot 173 into the pocket where the body portion 182*a* is deflected to a substantially vertical position as it moves through the pocket and out of a discharge slot 175. The connector portion 185 extends generally horizontally, as viewed in FIG. 8.

When cylinder 26*c* is actuated moving pulley 26, the upper surface of connector 185 is engaged by belt 22 and the lower surface of connector 185 engages the neck of the bag causing the tag to be moved through the pocket and through the exit slot 175. Thus, the tag is positioned adjacent the bag while connector portion 185 is moved along with the neck of the bag toward bag stop lever 80. The neck of the bag and connector portion 185 are encircled by ribbon 15 to securely attaching the tag to the bag.

When neck of a bag engages arm 88 the motor driving the driven pinch roller 160 is energized causing the strip of tags to be advanced. The trigger signal from the servo tyer trigger switch 86 and photo eye 165 provide the input signals for controlling the tag attachment device 100. Outputs from the electric controller include power for the variable speed motor 120*b* having a shaft for driving the driven roller 120. Signals are also delivered to the clutch that controls rotation of pinch roller 160 and a brake. A cutter control signal and air cylinder control signal for actuating the parallel linkage mechanism 130 are also sent. In addition, a signal is sent for actuating air cylinder 26*c* for moving gathering belt 22 into engagement with the tag.

It is to be understood that while detailed descriptions of a preferred embodiment has been illustrated and described, the invention is not to be limited to the specific arrangement of parts and specific features herein described and illustrated in the drawing. Rather, the descriptions are merely of an exemplary embodiment of the invention, which may be embodied in various forms.

A modified form of the apparatus is illustrated in FIGS. 11, 12 and 13 of the drawing. Referring to FIGS. 9 and 11, it will be noted that rollers 132 and 134 for urging the belt 115 have been replaced by a roller 233, as best illustrated in FIG. 13 of the drawing. Roller 233 is mounted on arm 233*a* of a bell crank pivotally supported on a pin 233*c*. A pin 235*a* pivotally secures arm 233*a* to one end of a link 235. The opposite end of link 235 is pivotally connected by a pin 235*b* to a linear actuator, such as solenoid 240.

As best illustrated in FIG. 11 of the drawing, a spool holder generally designated by the numeral 200 includes a bar 202 pivotally secured by a pin 204 to the upper end of a post 205 and has idler rollers 206 and 208 mounted thereon. A spool 210 of tag material is rotatably mounted on bar 202. Strip 180 of tags extends from spool 210 around idler rollers 209, 208, 207 and 206 into a funnel 210 at the entry area 168 into tag attachment device 100.

A spring 201 urges bar 202 from the position shown in dashed outline to the position illustrated in full outline for maintaining tension on the strip 180 of tags.

A belt 163 extends around driven roller 160 and idler roller 164 for advancing strip 186 toward cutter 150.

What is claimed is:

1. A method for securing a tag to a bag comprising the steps of:

cutting a tag from a strip of tags joined by connectors for forming a tag on one end of the connector and a tail piece on the other end of the connector;

positioning a tag cut from the strip of tags adjacent a path;

moving a bag along the path toward a gathering belt;

moving the gathering belt into engagement with the tag and the bag neck; and securing a closure around the tag and the bag neck such that the closure engages the connector between the tail piece and the tag.

2. A method of securing a tag to a bag according to claim 1, with the addition of the step of:

moving index marks on the strip of tags adjacent an electric eye to deliver signals to a controller.

3. A method of securing a tag to a bag according to claim 1, the step of positioning a tag adjacent a path comprising the steps of:

moving a tag along a guide surface such that the body of the tag is deflected at an angle of approximately 90° relative to a connector portion of the tag;

moving the body portion of the tag through an entrance slot into a pocket; and moving the tag through the pocket to an exit opening.

4. A tag attachment device for a tying machine having gathering belts for moving a bag neck along a path comprising:

a guide plate;

a continuously moving tag feed belt adjacent said guide plate, said tag feed belt extending transversely of gathering belts that move a bag neck along the path; and a pair of rollers arranged to move in unison toward and away from said guide plate for moving said tag feed belt into driving engagement with a tag for positioning the tag adjacent the path along which the bag neck is moved in the tying machine.

5. A tag attachment device according to claim 4, said tag attachment device further comprising:

means for cutting a tag from a strip of tags joined by connectors for forming a tag on one end of the connector and a tail piece on the other end of the connector;

means for positioning a tag cut from the strip of tags adjacent said guide plate such that when said rollers engage said tag feed belt a tag is moved along said guide plate toward said path where the tying machine secures a closure around the tag and the bag neck such that the closure engages the connector between the tail piece and the tag.

6. A tag attachment device according to claim 5, with the addition of:

an electric eye;

a controller; and means for moving index marks on the strip of tags adjacent said electric eye to deliver signals to said controller.

7. A tag attachment device according to claim 5, said means for positioning a tag cut from the strip of tags adjacent said guide plate comprising:

means for moving a tag along a guide surface such that the body of the tag is deflected at an angle of approximately 90° relative to a connector portion of the tag;

means for moving the body portion of the tag through an entrance slot into a pocket; and means for moving the tag through the pocket to an exit opening.

8. A tag attachment device for a tying machine for closing a bag and securing a tag to the bag comprising:

means for cutting a tag from a strip of tags joined by connectors for forming a tag on one end of the connector and a tail piece on the other end of the connector;

means for positioning a tag cut from the strip of tags adjacent a path;

means for moving a bag along the path toward a gathering belt;

means for moving the gathering belt into engagement with the tag and the bag neck; and means for securing a closure around the tag and the bag neck such that the closure engages the connector between the tail piece and the tag.

9. A tag attachment device for a tying machine according to claim 8, with the addition of:

an electric eye;

a controller; and means for moving index marks on the strip of tags adjacent said electric eye to deliver signals to said controller for controlling movement of the strip of tags to said means for cutting a tag from a strip of tags joined by connectors for forming a tag on one end of the connector and a tail piece on the other end of the connector.

10. A tag attachment device for a tying machine according to claim 8, said means for positioning a tag adjacent said path comprising:

means for moving a tag along a guide surface such that the body of the tag is deflected at an angle of approximately 90° relative to a connector portion of the tag;

means for moving the body portion of the tag through an entrance slot into a pocket; and means for moving the tag through the pocket to an exit opening.

11. A tag attachment device for a tying machine having:

a source of ribbon for dispensing a strand of ribbon having a free end and a central portion;

a holder-shear assembly for holding the free end of said ribbon adjacent a path;

a needle assembly for engaging and positioning said central portion of said ribbon adjacent said holder-shear assembly; and a twister assembly having a hook adjacent said holder-shear assembly, wherein the tag attachment device comprises:

a guide plate;

a continuously moving tag feed belt adjacent said guide plate, said tag feed belt extending transversely of said path; and a pair of rollers arranged to move in unison toward and away from said guide plate for moving said drive belt into driving engagement with a tag for positioning the tag adjacent said path.

12. A tag attachment device for a tying machine according to claim 11, said guide plate having:

an end portion, an inclined section, a deflected portion, a generally horizontally extending portion and a curved guide surface configured such that when a tag is positioned on said end portion of guide plate, it will be moved by tag feed belt for moving the tag downwardly along said inclined section and along said generally horizontally extending portion and curved guide surface such that the body of the tag is deflected at an angle of approximately 90° relative to a connector portion of the tag.

* * * * *